US005192002A

United States Patent [19]

Reese et al.

[11] Patent Number: 5,192,002

[45] Date of Patent: Mar. 9, 1993

[54] INGREDIENT MIXING BOWL AND EVACUATION SYSTEM

[75] Inventors: Robert J. Reese, St. Charles; Franklin D. Newkirk, Florissant, both of Mo.

[73] Assignee: Unidynamics Corporation, New York, N.Y.

[21] Appl. No.: 769,961

[22] Filed: Oct. 1, 1991

[51] Int. Cl.[5] ..... B67D 1/16

[52] U.S. Cl. ..... 222/108; 222/129.2; 222/129.4; 366/139; 99/275

[58] Field of Search ..... 222/108, 129.1, 129.2, 222/129.3, 129.4, 145; 366/139, 163; 99/275

[56] References Cited

U.S. PATENT DOCUMENTS

| | | | |
|---|---|---|---|
| 2,614,738 | 10/1952 | Mills | 222/108 |
| 2,843,293 | 7/1958 | Burgoyne | 222/129.4 |
| 3,300,094 | 1/1967 | Rockola | 222/129.4 |
| 3,385,569 | 5/1968 | Bookout | 222/129.4 X |
| 3,511,413 | 5/1970 | Fuqua | 222/129.1 |
| 3,727,891 | 4/1973 | Brill | 222/129.1 X |
| 4,194,651 | 3/1980 | Martin et al. | 222/108 |

*Primary Examiner*—Andres Kashnikow
*Assistant Examiner*—Kenneth Bomberg
*Attorney, Agent, or Firm*—Senniger, Powers, Leavitt & Roedel

[57] ABSTRACT

A mixing device and overflow evacuation system for a vending machine which is capable of mixing a predetermined portion of dry ingredient with a liquid and vending the resultant mixture. The mixing bowl is generally conically shaped and open at its upper end with an annular cap covering the upper end with a central opening which permits the dry ingredient to be dispensed into the mixing bowl therethrough. The liquid is injected so as to cause the liquid to move in a generally spiral path around the mixing bowl and the dry ingredient is injected into the path of the liquid so that the two are mixed. The mixing bowl is provided with baffles in the lower portion thereof which break up the flow and cause the mixture to pass through an outlet spout. The evacuation system includes a vacuum tube connected to the upper portions of each of the mixing bowls to remove steam therefrom when hot liquids are being used. In the case of a clogged mixing bowl, the overflow system will remove the liquid and transport it to a catch basin to prevent an overflow of the liquid in the machine.

3 Claims, 4 Drawing Sheets

INGREDIENT MIXING BOWL AND EVACUATION SYSTEM

BACKGROUND OF THE INVENTION

The present invention relates to vending machines, and more particularly, to a system for mixing dry ingredients with liquids prior to their being dispensed by the vending machine.

Vending machines which mix predetermined amounts of dry ingredients and liquids have been known for some time. They are generally provided with some device for mixing the dry ingredients with the liquids in their premeasured forms. The resultant mixture is then dispensed from the mixing device to the cup station where it is dispensed into a cup where it can be removed by a customer. Many such vending machines dispense hot liquids such as coffee and tea, mixed with a variety of ingredients such as sugar and cream. Since the liquid with which the dry ingredients are mixed in such machines is generally heated to the boiling point and thus produces steam during the mixing process, the inside of the machines are often exposed to high humidity as the steam escapes from the mixing devices. Many attempts have been made to overcome this problem, however, most have been unsatisfactory in that they do not actually remove most of the steam and/or are of generally a complicated and expensive nature.

Another common problem with such vending machines is that in the mixing device if the dry ingredients and liquid are not introduced precisely at the right time, the outlet spouts of the mixing devices can become clogged. This results in the liquid and/or the mixture overflowing the mixing device on subsequent attempts to use by a customer which contaminates the inside of the entire vending machine, thus producing an unsanitary and difficult to clean problem.

SUMMARY OF THE INVENTION

The present invention overcomes the above-described difficulties and disadvantages associated with such prior art devices by providing a mixing bowl of generally cylindrical shape with an annular cap attached to its upper portion with a central opening through which the dry ingredients are injected, and an outlet spout through which the mixture exits, and which is provided with a steam outlet in its upper portion which is attached at a vacuum source to remove most if not all of the steam created when a high temperature liquid is mixed with the dry ingredients injected into the mixing bowl. In addition, a steam and overflow evacuation system is provided which through a suction on the steam evacuation outlet withdraws any liquid or mixture from the mixing bowl that would otherwise overflow the top cap and then distributes the overflow liquid and mixture to a catch basin where it can be easily removed from the machine.

DETAILED DESCRIPTION OF THE PREFERRED EMBODIMENT

Figure 1:
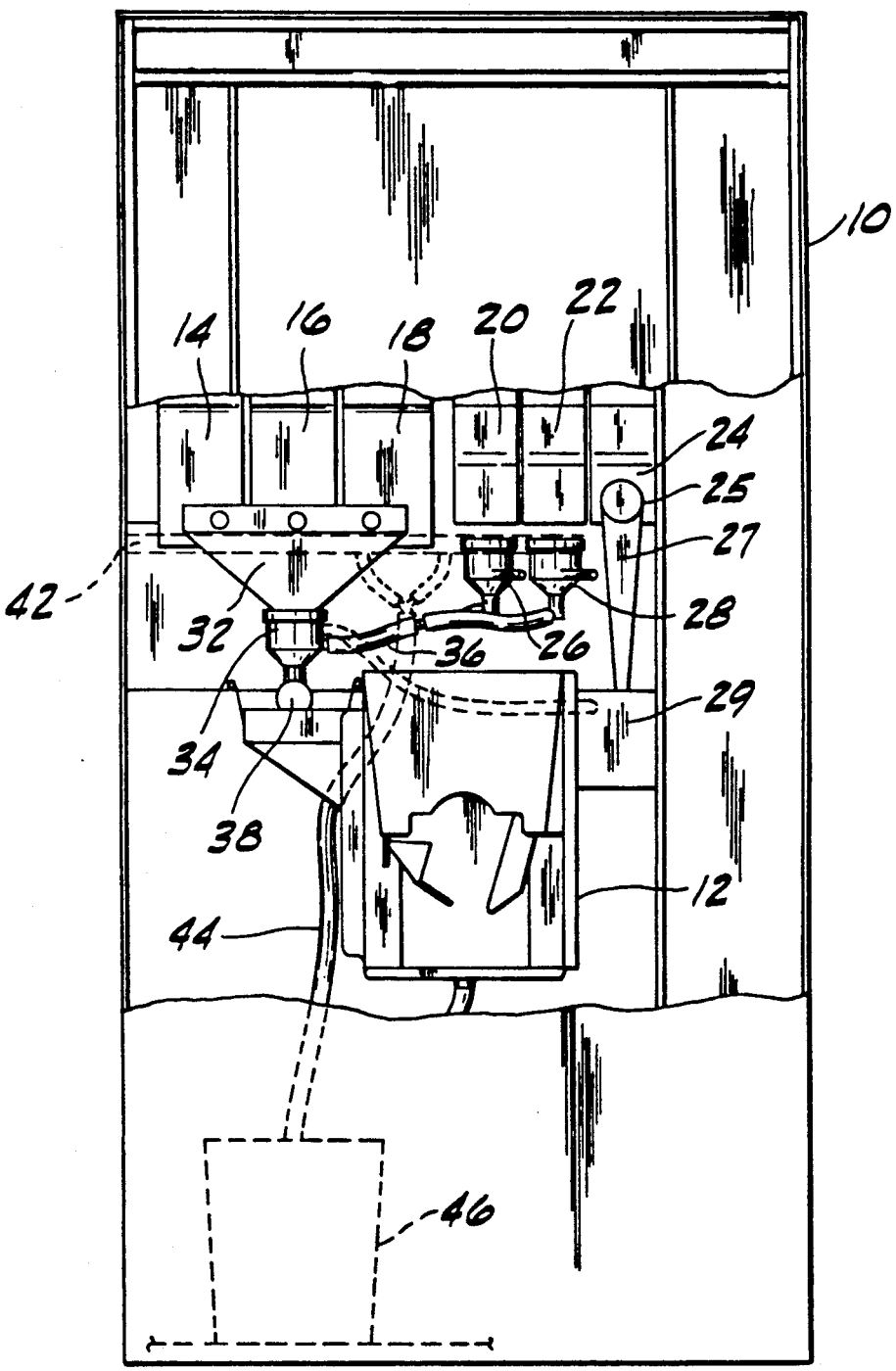
FIG. 1 is a front elevational view of a vending machine with a portion cutaway to show the mixing bowl and evacuation system of the preferred embodiment.
Figure 2:
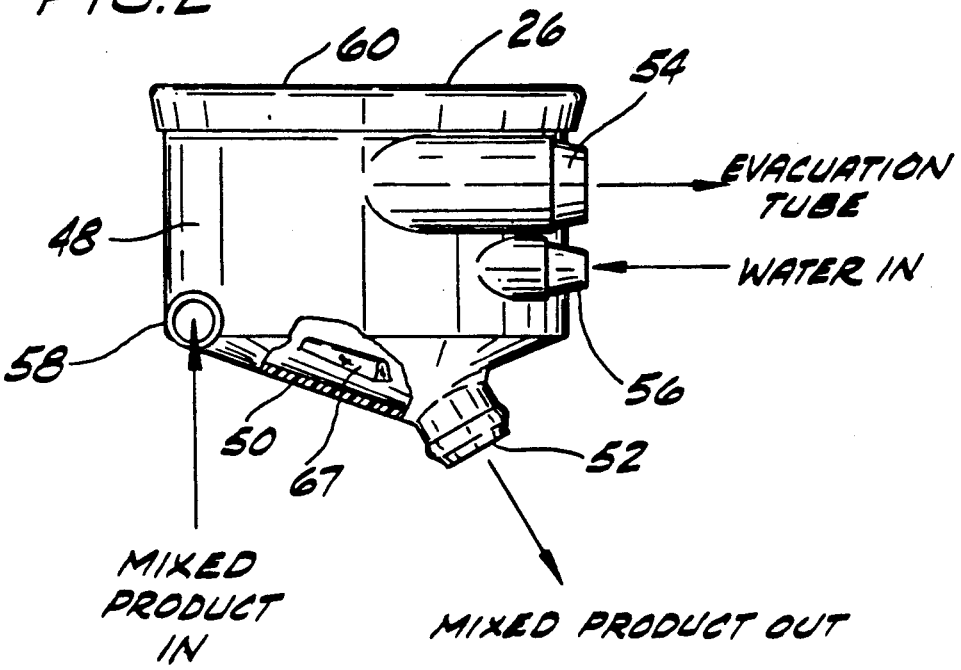
FIG. 2 is an enlarged side view of the mixing bowl of the preferred embodiment.
Figure 5:
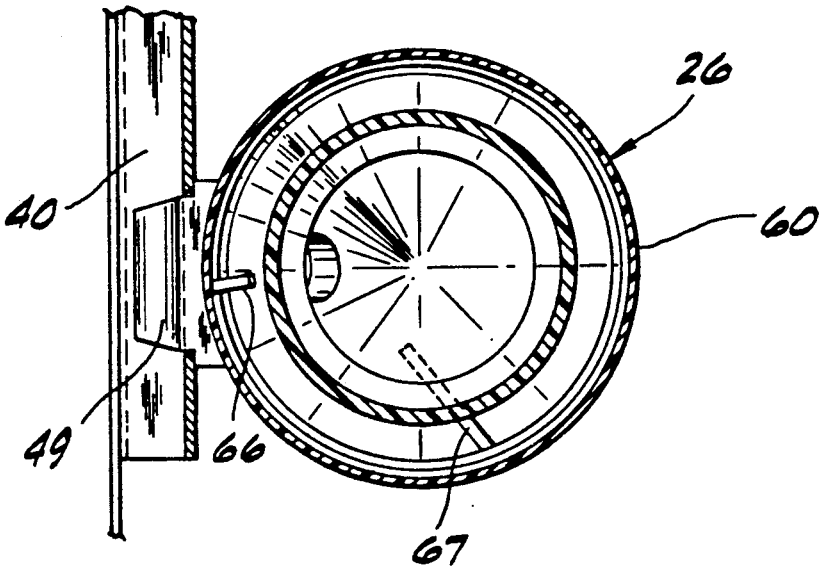
FIG. 5 is a cross-sectional view along the line 5—5 of FIG. 4.
Figure 3:
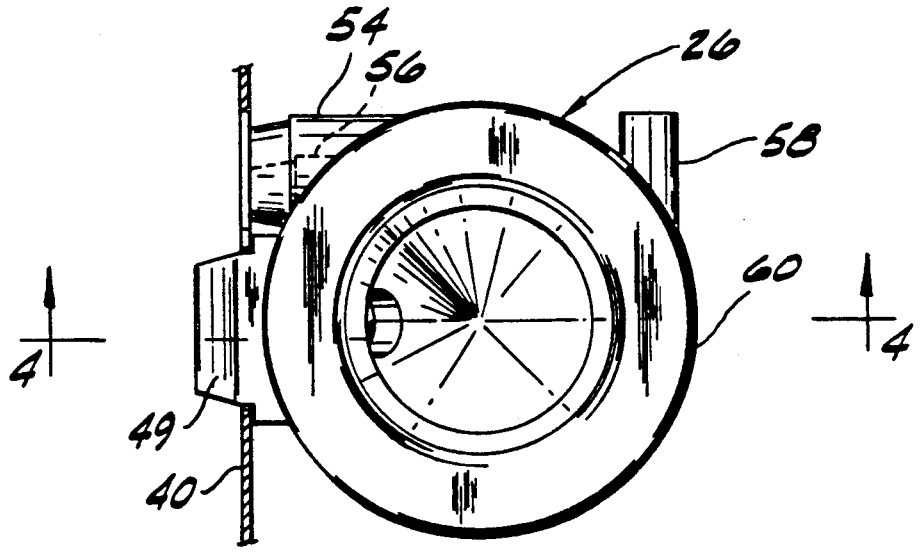
FIG. 3 is a top view of the mixing bowl of FIG. 2.
Figure 4:
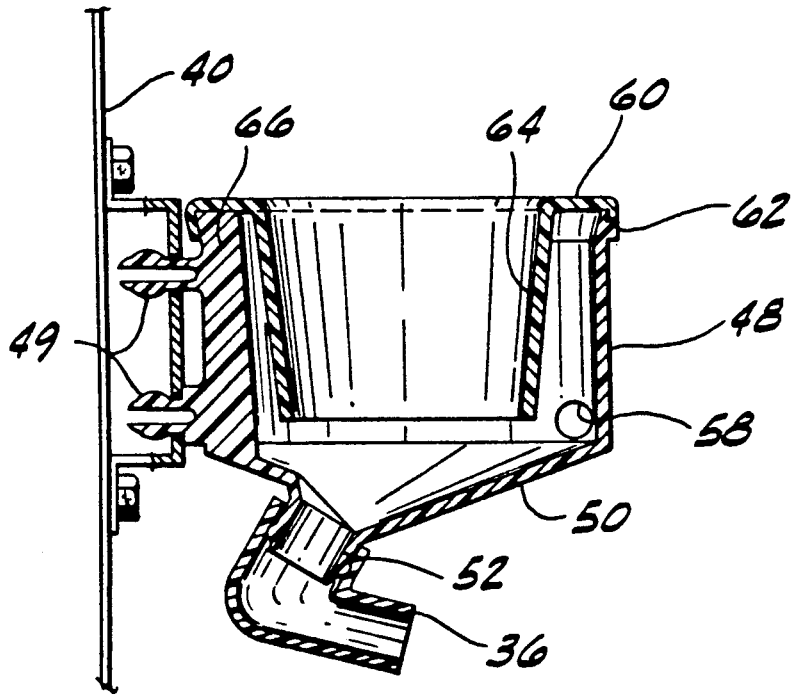
FIG. 4 is a sectional view in the direction of line 4—4 of FIG. 3.

A vending machine 10 is shown in FIG. 1 and is of the general type to which the present invention pertains in that it is a liquid dispensing type of vending machine from which the customer selects the type of drink that he wishes, such as coffee or tea, then the machine through its systems mixes a predetermined amount of dry ingredient with a liquid, such as hot water, and then dispenses the mixture to a cup station where a cup is dropped into position and then the mixture is dispensed into it. The cup station 12 is shown in the cutaway portion of FIG. 1.

In the preferred embodiment, the vending machine 10 is a coffee, hot chocolate, and tea vending machine, although it is contemplated that the systems of the present invention could be utilized on other types of liquid dispensing vending machines as well. However, referring to the embodiment shown, canisters 14 are shown mounted at various locations within the vending machine 10 for holding large quantities of dry ingredients, such as milk, sugar, chocolate, cream, tea and coffee, which are dispensed in measured amounts such as by augering or the like, the details of which are not relevant to the present invention. For example, the three canisters 20, 22, and 24, could respectively be filled with tea, decaffeinated coffee and regular coffee, either previously ground or beans with provision being made such as grinder 25 for grinding the beans. Beneath each of the canisters 20 and 22 is a respective mixing bowl 26 and 28 of the present invention which are each disposed for receiving the measured portion of ingredients from the respective canisters.

Likewise, the canisters 14, 16, and 18, for example, can respectively be filled with dry creamer, sugar, and sugar substitute. These three canisters each deposit their premeasured amounts into a common trough 32 which in turn dumps into a further mixing bowl 34. In this arrangement, the mixture from one of the mixing bowls 26 or 28 is passed through a supply tube 36 to the mixing bowl 34 where it mixes with one or more of the ingredients from the containers 14, 16, and 18 and is then supplied to the cup station 12. In the case of coffee ground by grinder 25 from beans stored in canister 24, the ground coffee passes from grinder 25 through a chute 27 to a coffee brewer 29 shown schematically since it forms no part of the present invention. After the coffee is brewed, it is forced from the brewer 29 with compressed air through tube 30 and into inlet 56 of mixing bowl 34 where it is then mixed with dry ingredients from canisters 14–18 as desired. Intermediate the mixing bowl 34 and cup station 12 is a whipping assembly 38 which is utilized for some mixtures, such as hot chocolate. The whipping assembly 38 generally utilizes an impeller which is run at high speeds to cause foaming of the mixture prior to its being deposited in a cup in the cup station.

Shown in hidden line behind the support panel 40 which supports the mixing bowls 26, 28, and 34, is the steam and overflow evacuation tube 42. The evacuation tube 44 is connected to each of the mixing bowls 26, 28, and 34, in a manner described in more detail below, for removing steam and potentially overflowing liquids from the mixing bowls and then depositing them in the tubing 44 into a catch basin 46.

Referring more particularly to one of the mixing bowls, such as mixing bowl 26 shown in FIGS. 2-5, they are formed with a generally cylindrical portion 48 merging into a lower generally conical portion 50 and terminating in an exit spout 52. In the upper portion of the cylindrical portion 48 is the steam and overflow outlet 54. Just beneath outlet 54 is disposed, at approximately 90 degrees to the inlet 56 is a second mixture inlet 58 which is also lower in the cylindrical portion 48. The steam and overflow outlet as well as the water and mixture inlets 56 and 58 are disposed generally tangent to the cylindrical portion 48 of the mixing bowl 26. Thus, water introduced through inlet 56 and the liquid mixture introduced through the inlet 58 produce a vortex motion of the liquid as gravity draws the liquid down into the conical portion 50 towards the outlet or exit spout 52.

A baffle 66 is formed in the rear inner surface of conical portion 48 and a similar baffle 67 is formed on the inner surface of conical portion 50, both of which are used to disrupt the otherwise spiral flow of liquid around the inner surfaces of mixing bowl 26 and cause the mixture of liquid and ingredient to pass through exit spout 52.

Molded into the rear of cylindrical portion 48 are a pair of flexible fastening members 49. Corresponding receiving slots are formed in the support plate 40 for easily mounting the mixing bowl 26 in the proper predetermined locations in the vending machine 10. Forming part of the mixing bowl is a cap 60 which is preferably formed of a semi-flexible, plastic material that allows the edges 62 of the cap to snap over and lockingly engage the upper side portions of the cylindrical portion 48 of the mixing bowl 26. The inner flange 64 of the cap 60 is generally conically shaped and is spaced from the inside cylindrical wall of cylindrical portion 48.

Figures 6, 7:
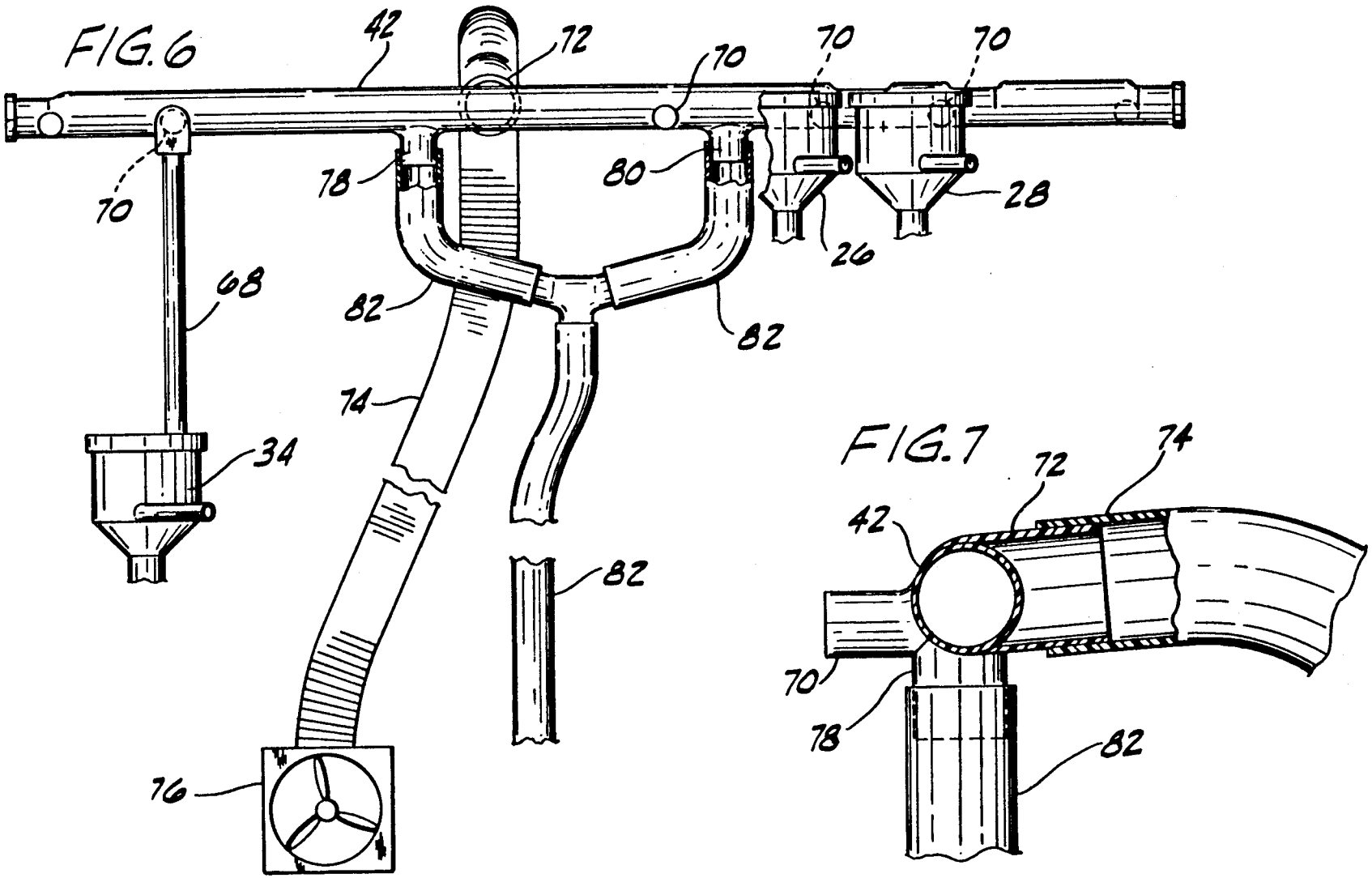
FIG. 6 is a front elevational view of the evacuation system of the preferred embodiment.
FIG. 7 is an end view of the evacuation tube.

Referring now to the steam and overflow evacuation system, as best seen in FIGS. 1 and 6, it basically comprises the steam and overflow evacuation tube 42 which is interconnected to each of the mixing bowls 26, 28, and 34 through the steam and overflow outlets 54 of each. Since, as can be seen from FIG. 1, the mixing bowls are disposed at different vertical locations on the support plate 40, only some of the mixing bowls, such as 26 and 28 as illustrated, can be directly connected to the steam and overflow evacuation tube 42. Others of the mixing bowls, such as 34, are connected via an extension tube 68 which interconnects the steam and liquid overflow outlet 54 to the associated inlet port 70 of the evacuation tube 42. Tube 42 is closed at its ends and is provided with a suction port 72 connected through flexible tubing 74 to a fan 76. A pair of liquid drain ports 78 and 80 are provided in the tube 42 and which are connected through the drain tube 82 to a catch basin 46.

Referring now to the operation of the system of the present invention, referring first to FIG. 1, and assuming a customer has selected and paid for freeze-dried coffee which is contained in canister 22, the dry coffee granules are disbursed through a known means such as an auger into mixing bowl 28. Simultaneously with the dumping of the dry coffee into the opening in the cap 60 of mixing bowl 28, hot water is injected through the water inlet 56 from a source of hot water (not shown) and as a result of being injected around the periphery of the inside of the mixing bowl 28, swirls and entrains the dry coffee which is being dumped into the mixing bowl 28. The mixture as it swirls about the cylindrical and conical portions 48 and 50, encounters the baffles 66 and 67 which causes further mixing of the dry ingredients with the hot water and disrupts the circulatory flow of the mixture so that it tends to gravity-feed through the exit spout 52. This mixture then passes through the tube 36 to mixing bowl 34 where simultaneously with its introduction through the port 58 in the mixing bowl is introduced the selected ingredients from containers 14, 16, and 18 through the trough 32 and into the opening in the cap 60 of mixing bowl 34. It is then passed to the cup station 12 where it is delivered into a cup positioned therein.

Referring back to the mixing bowl 28, as the water is initially introduced through the inlet 56, a suction is produced at the steam and overflow evacuation tube 54 as a result of operation of the fan 76 producing a vacuum on the tube 74 and thus on the evacuation tube 42. This then draws the steam off from under the cap 60 and into the evacuation tube 42 where it accumulates as liquid droplets and eventually passes through the liquid overflow from the drain port 78 and 80 and into the catch basin 46. If during operation of the mixing bowl, such as 28, a clogging occurs of the exit port 52, which can happen as a result of a dry mixture not properly mixing with the liquid and thus forming a large plug which plugs the outlet port 52. On subsequent attempts to vend a mixture which would utilize the same mixing bowl which is plugged, the liquid will tend to overfill the mixing bowl and flow out through the opening in the cap 60. However, because of the suction on the steam and overflow port 54, the water will be drawn off into the steam and overflow evacuation tube 42 and thus not be permitted to overflow the top cap of the mixing bowl. This overflow water, then, will pass through the drain ports 78 and 80 and through the drain tubes 82 and into the catch basin 46.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. An overflow evacuation system for mixing bowls in a vending machine for producing and dispensing mixed beverages formed from a mixture of selected dry ingredients and liquids, said system comprising:

a plurality of mixing bowls of generally conical shape each having an open upper portion and forming an outlet spout in their lower portion from which the mixed beverage is expelled, an annular cap covering said upper portion and having a central opening through which said dry ingredients can be introduced, steam evacuation means in said upper portion of said mixing bowl connected to a vacuum source for producing a vacuum for removing steam from said bowl and for removing overflow liquid from said bowl when it becomes clogged;

an evacuation tube interconnected to said evacuation means of each said mixing bowl, said tube being connected to said vacuum source and having at least one liquid outlet means downstream of said mixing bowl and upstream of said vacuum source for removing liquid from said tube;

said evacuation tube having a first tube portion disposed generally horizontally and having a plurality of inlets each connected to a respective steam evacuation means of each said mixing bowl, a second tube portion connecting said vacuum source with said first tube portion through an inlet in a side portion of the first tube portion, and at least one drain port in a bottom portion of the first tube portion.

2. An overflow evacuation system for mixing bowls in a vending machine for producing and dispensing mixed beverages formed from a mixture of selected dry ingredients and liquids, said system comprising:

a plurality of mixing bowls of generally conical shape each having an outlet in its lower portion from which the mixed beverage is expelled, a cap covering an upper portion of each mixing bowl and having a central opening through which said dry ingredients are introduced into each mixing bowl, steam evacuation means in said upper portion of each said mixing bowl for removing steam from said bowls and for removing overflow liquid from said bowls when they become clogged, a vacuum source, an evacuation tube connected to said evacuation means of each said mixing bowl and to said vacuum source for causing a vacuum in said steam evacuation means to remove steam and overflow liquid therefrom, said evacuation tube having at least one liquid outlet means between said vacuum source and said evacuation means for removing liquid from said tube before it reaches said vacuum source, said evacuation tube having a first tube portion disposed generally horizontally and having a plurality of inlets each connected to a respective steam evacuation means of each said mixing bowl, a second tube portion connecting said vacuum source with said first tube portion through an inlet in a side portion of the first tube portion, and at least one drain port in a bottom portion of the first tube portion.

3. An overflow evacuation system as defined in claim 2 wherein there are two drain ports in the second tube portion disposed on opposite sides of the inlet connecting the vacuum source with the second tube portion.

* * * * *

UNITED STATES PATENT AND TRADEMARK OFFICE

CERTIFICATE OF CORRECTION

PATENT NO. : 5,192,002

DATED : March 9, 1993

INVENTOR(S) : Robert J. Reese et al.

It is certified that error appears in the above-identified patent and that said Letters Patent is hereby corrected as shown below:

Column 6, claim 3, line 2, "the second tube" should read ---the first tube---.

Signed and Sealed this

Thirtieth Day of November, 1993

*Attest:*

*Attesting Officer*

BRUCE LEHMAN

*Commissioner of Patents and Trademarks*